US005173356A

United States Patent [19]

Eaton et al.

[11] Patent Number: 5,173,356

[45] Date of Patent: Dec. 22, 1992

[54] SELF-BONDED FIBROUS NONWOVEN WEBS

[75] Inventors: Geraldine M. Eaton, Acworth; Peter W. Pascavage; Walter H. Stover, both of Marietta, all of Ga.; James L. Harris, Hickson, Tenn.; Larry D. Carter, Hazlehurst, Ga.

[73] Assignee: Amoco Corporation, Chicago, Ill.

[21] Appl. No.: 556,353

[22] Filed: Jul. 20, 1990

Related U.S. Application Data

[63] Continuation-in-part of Ser. No. 411,908, Sep. 25, 1989, abandoned.

[51] Int. Cl.[5] ..... B32B 5/06

[52] U.S. Cl. ..... 428/219; 428/284; 428/286; 428/296; 428/297; 428/298; 428/903; 428/233

[58] Field of Search ..... 428/296, 288, 284, 286, 428/297, 298, 903, 219, 233

[56] References Cited

U.S. PATENT DOCUMENTS

| | | | |
|---|---|---|---|
| 3,276,944 | 10/1966 | Levy | 161/150 |
| 3,338,992 | 8/1967 | Kinney | 264/24 |
| 3,849,241 | 11/1974 | Butin et al. | 428/296 |
| 4,340,563 | 7/1982 | Appel et al. | 264/218 |
| 4,790,736 | 12/1988 | Keuchel | 425/66 |
| 4,863,785 | 9/1989 | Berman et al. | 428/218 |

*Primary Examiner*—James J. Bell

*Attorney, Agent, or Firm*—Robert G. Ladd; Robert J. Wagner; Frank J. Sroka

[57] ABSTRACT

A self-bonded, fibrous nonwoven web having a uniform basis weight of about 0.1 oz/yd$^2$ or greater and improved physical properties, a method for producing same and composite fabrics comprising the nonwoven web useful for applications in for example, hygiene, healthcare and agriculture markets.

21 Claims, 2 Drawing Sheets

SELF-BONDED FIBROUS NONWOVEN WEBS

CROSS-REFERENCE TO RELATED APPLICATION

This application is a continuation-in-part application of U.S. Ser. No. 411,908 filed Sep. 25, 1989, now abandoned.

FIELD OF THE INVENTION

This invention relates to a self-bonded, fibrous nonwoven web having a very uniform basis weight of about 0.1 oz/yd$^2$ or greater and physical properties in the machine direction and cross machine direction which are balanced, an improved process for producing same and composite products comprising the nonwoven web useful for product applications in the hygiene, medical, healthcare, agricultural and other markets.

BACKGROUND OF THE INVENTION

Fibrous nonwoven webs are well known for a wide variety of end uses, such as wipes, surgical gowns, dressings, etc. Fibrous nonwoven webs have been formed by a variety of processes including meltblowing and spunbonding.

In the spunbonding process a multiplicity of continuous thermoplastic polymer strands are extruded through a die in a downward direction onto a moving surface where the extruded strands are collected in a randomly distributed fashion. These randomly distributed strands are bonded together by thermobonding or by needlepunching to provide sufficient integrity in a resulting nonwoven web of continuous fibers. One method of producing spunbonded nonwoven webs is disclosed in U.S. Pat. No. 4,340,563. Spunbonded webs are characterized by a relatively high strength/weight ratio, isotropic strength, high porosity, good abrasion resistance and are useful in a wide variety of applications including diaper liners, street repair fabric and the like.

The meltblowing process differs from the spunbonding process in that polymeric webs are produced by heating the polymer resin to form a melt, extruding the melt through a die orifice in a die head, directing a fluid stream, typically an air stream, toward the polymer melt exiting the die orifice to form filaments or fibers that are discontinuous and attenuated, and depositing the fibers onto a collection surface. Bonding of the web to achieve integrity and strength occurs as a separate downstream operation. Such a meltblown process is disclosed in U.S. Pat. No. 3,849,241. Meltblown webs are characterized by their softness, bulk absorbency, and relatively poor abrasion resistance and are useful for product applications such as surgical drapes and wipes.

U.S. Pat. No. 4,863,785 discloses a nonwoven composite material with a melt-blown fabric layer sandwiched between two prebonded, spunbonded reinforcing layers, all continuously-bonded together. The spunbonded material requires prebonding, and no parameters or methods of measurement of uniform basis weight are identified.

A major limitation that can be observed in many commercially available spunbonded webs is nonuniform coverage, such that areas of coverage in the fabric which are thicker or which are thinner are very noticeable, giving the webs a "cloudy" appearance. Basis weight of the spunbonded webs can vary significantly from one region of the web to another. In many applications, attempts are made to compensate for the poor fabric aesthetics and physical properties that result from this nonuniformity of coverage and basis weight by using webs having a greater number of filaments and a heavier basis weight than would normally be required by the particular application if the web had a more uniform coverage and basis weight. This, of course, adds to the cost of the product and contributes to stiffness and other undesirable features.

Meltblown fabrics, in constrast, are more uniform in coverage but have a limitation of low tensile strength. Many lower basis weight meltblown webs are marketed as composite fabrics with the low basis weight meltblown web sandwiched between two layers of spunbonded fabric to provide sufficient strength for processing and end use.

U.S. Pat. No. 4,790,736, incorporated herein by reference, discloses an apparatus for centrifugal fiber spinning of various thermoplastic resins with pressure extrusion for producing continuous nonwoven fabrics. Filament or fiber deniers ranging in value from 5 to 27 g/9000 m and a two-ply, lay-flat fabric having a basis weight of 0.75 oz/yd$^2$ produced from nylon-6 polymer are disclosed. These nonwoven webs have good strength and coverage, particularly at basis weights above 1 oz/yd$^2$; however, greater uniformity of coverage at lower basis weights would be desirable.

In view of the limitations of the spunbond and meltblown fabrics produced by known processes, there is a need for a self-bonded, fibrous nonwoven web material having very uniform basis weight properties and balanced physical properties, such that physical properties in the machine direction are approximately the same as properties in the cross machine direction, an improved process to prepare same and composite products comprising the nonwoven material bonded to at least one additional fabric, film or nonfabric material.

As used herein, a nonwoven web having uniform basis weight is taken to mean a nonwoven web which has a Basis Weight Uniformity Index (BWUI) of $1.0 \pm 0.05$, wherein the BWUI is defined as a ratio of an average unit area basis weight determined on a unit area sample of the web to an average area basis weight determined on an area sample, N times as large as the unit area sample, wherein N is about 12 to about 18, the unit area sample has an area of 1 in$^2$, and wherein standard deviations of the average unit area basis weight and the average area basis weight are less than 10% and the number of samples is sufficient to obtain average basis weights at a 0.95 confidence interval. For example, for a nonwoven web in which 60 samples of 1 in$^2$ squares determined to have an average basis weight of 0.993667 oz/yd$^2$ and a standard deviation (SD) of 0.0671443 (SD of 6.76% of the average) and 60 samples of 16 in$^2$ squares (N was 16) determined to have an average basis weight of 0.968667 oz/yd$^2$ and a standard deviation of 0.0493849 (SD of 5.10% of average), the calculated BWUI was 1.026.

Accordingly, it is an object of the present invention to provide a self-bonded, fibrous nonwoven web having a very uniform basis weight and tensile properties which are more evenly balanced in the machine and cross machine directions.

Another object of the present invention is to provide a self-bonded, fibrous nonwoven web comprising a plurality of substantially continuous polymeric filaments having a uniform basis weight of 0.1 oz/yd$^2$ or greater wherein the polymeric filaments comprise a thermoplastic selected from the group consisting of polypropylene, high density polyethylene, low density polyethylene, linear low density polyethylene, polyamide, polyester, a blend of polypropylene and polybutene, and a blend of polypropylene and linear low density polyethylene.

A further object of the present invention is to provide a uniform basis weight self-bonded, fibrous nonwoven web for use in composite products in which the nonwoven web is bonded to at least one additional fabric, film or nonfabric material.

A still further object is to provide an improved method for producing a self-bonded, fibrous nonwoven web having a very uniform basis weight.

SUMMARY OF THE INVENTION

The objects of this invention are provided in a self-bonded, fibrous nonwoven web comprising a plurality of substantially randomly disposed, substantially continuous polymeric filaments having a basis weight of about 0.1 oz/yd$^2$ or greater with a Basis Weight Uniformity Index (BWUI) of 1.0±0.05.

In one aspect, the invention provides a self-bonded, fibrous nonwoven web comprising a plurality of substantially randomly disposed, substantially continuous polymeric filaments having a basis weight of about 0.1 oz/yd$^2$ or greater wherein the polymeric filaments comprise a thermoplastic selected from the group consisting of polypropylene, high density polyethylene, low density polyethylene, linear low density polyethylene, polyamide, polyester, a blend of polypropylene and polybutene, and a blend of polypropylene and linear low density polyethylene having balanced physical properties, such as tensile strength, for use in the hygienic materials market, for the medical and health care market, for weed control and seed crop cover in agricultural markets and for other markets.

In another aspect, the invention provides a composite product comprising the uniform basis weight, self-bonded, fibrous nonwoven web bonded to at least one additional fabric, film or nonfabric material.

In a further aspect, the invention describes an improved method for forming self-bonded, fibrous nonwoven webs having a uniform basis weight of 0.1 oz/yd$^2$ or greater.

Among the advantages provided by the nonwoven web of the present invention are very uniform basis weight nonwoven webs of 0.1 oz/yd$^2$ or greater and good physical properties, such as tensile strength, in both MD and CD. The self-bonded, fibrous nonwoven web can be used for certain applications without secondary bonding in contrast to conventional spunbonding which typically requires a separate bonding step. Also, the self-bonded, nonwoven web has greater web strength than conventional meltblown products. Thus, the nonwoven web of the present invention exhibits a desirable combination of uniformity in basis weight and coverage and of nearly balanced physical properties in the MD and CD making it useful in a wide range of applications such as surgical gowns, weed control and crop cover, tents, housewrap and the like.

DETAILED DESCRIPTION OF THE INVENTION

Figure 1:
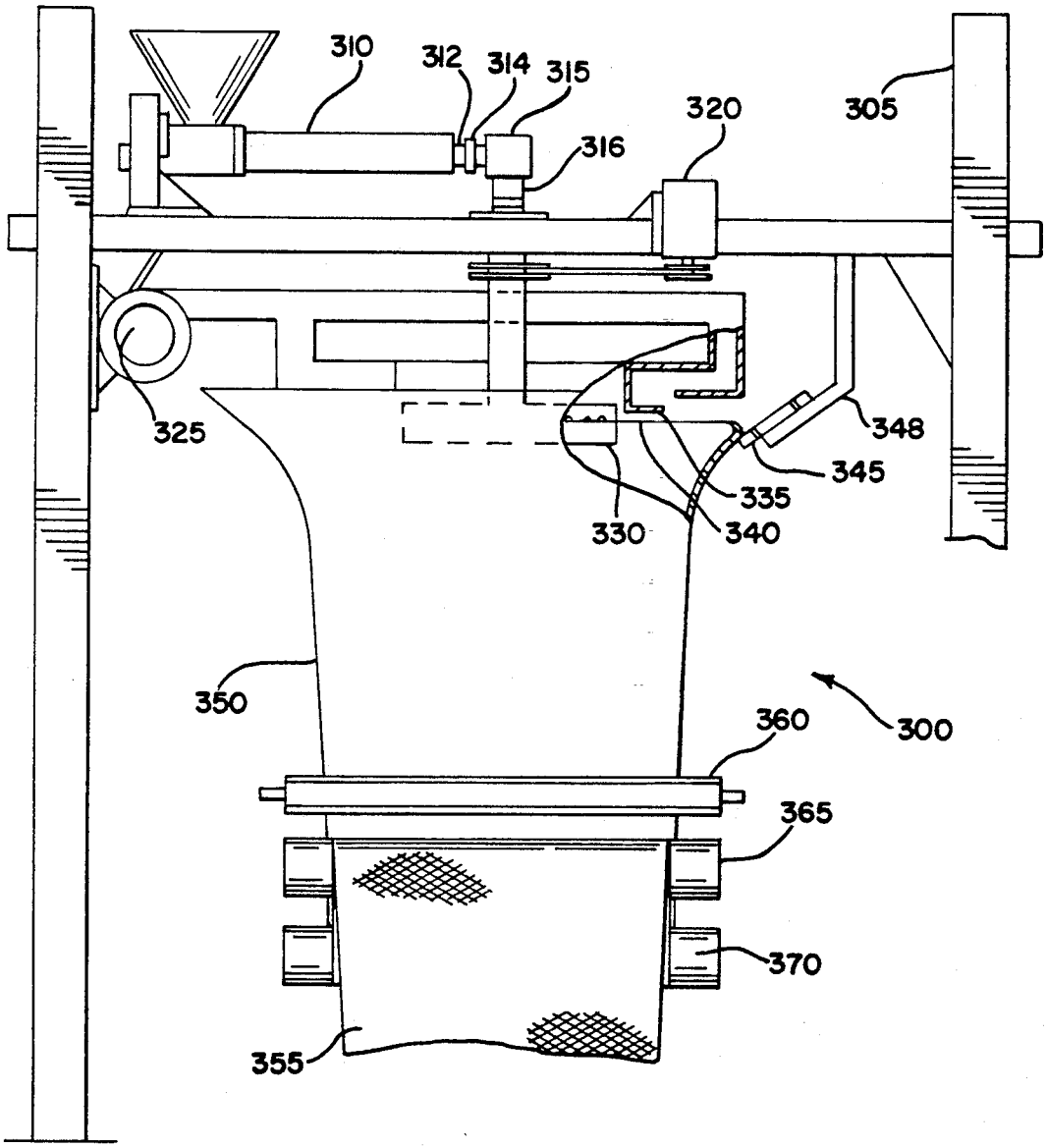
FIG. 1 is a schematic illustration of the system used to produce the self-bonded, fibrous nonwoven web of the present invention.

The nonwoven web of the present invention is a self-bonded, fibrous web comprising a plurality of substantially randomly disposed, substantially continuous polymeric filaments having a denier in the range of about 0.5 to about 20. The nonwoven web produced from these filaments has a basis weight of about 0.1 oz/yd$^2$ or greater, and a Basis Weight Uniformity Index (BWUI) of 1.0±0.05.

By "nonwoven web" it is meant a web of material which has been formed without the use of weaving processes and which has a construction of individual fibers, filaments or threads which are substantially randomly disposed.

By "uniform basis weight nonwoven web" it is meant a nonwoven web comprising a plurality of substantially randomly disposed, substantially continuous polymeric filaments having a basis weight of about 0.1 oz/yd$^2$ or greater with filament deniers in the range of 0.5 to 20, for polypropylene this range of filament deniers corresponds to filament diameters in the range of about 5 to about 220 microns, and a BWUI of 1.0±0.05. BWUI is defined as a ratio of an average unit area basis weight determined on a unit area sample of web to an average basis weight determined on an area of web, N times as large as the unit area, wherein N is about 12 to about 18, the unit area is 1 in$^2$ and wherein standard deviations of the average unit area basis weight and the average basis weight are less than 10% and the number of samples is sufficient to obtain basis weights at a 0.95 confidence interval. As used herein for the determination of BWUI, both the average unit area basis weight and the average area basis weight must have standard deviations of less than 10% where "average" and "standard deviation" have the definitions generally ascribed to them by the science of statistics. Materials having BWUI's of 1.0±0.05 which are determined from average basis weights having standard deviations greater than 10% for one or both of the averages do not represent a uniform basis weight nonwoven web as defined herein and are poorly suited for use in making the invented self-bonded nonwoven webs because the nonuniformity of basis weights may require heavier basis weight materials to be used to obtain the desired coverage and fabric aesthetics. Unit area samples below about 1 in$^2$ in area for webs which have particularly nonuniform basis weight and coverage would represent areas too small to give a meaningful interpretation of the unit area basis weight of the web. The samples on which the basis weights are determined can be any convenient shape, such as square, circular, diamond and the like, with the samples randomly cut from the fabric by punch dies, scissors and the like to assure uniformity of the sample area size. The larger area is about 12 to about 18 times the area of the unit area. The larger area is required to obtain an average basis weight for the web which will tend to "average out" the thick and thin areas of the web. The BWUI is then calculated by determining the ratio of the average unit area basis weight to the average larger area basis weight. A BWUI of 1.0 indicates a web with a very uniform basis weight. Materials having BWUI values of less than 0.95 or more than 1.05 are not considered to have uniform basis weights as defined herein. Preferably, the BWUI has a value of 1.0±0.03.

By "self-bonded" it is meant that the crystalline and oriented filaments or fibers in the nonwoven web adhere to each other at their contact points thereby forming a self-bonded, fibrous nonwoven web. Adhesion of the fibers may be due to fusion of the hot fibers as they contact each other, to entanglement of the fibers with each other or to a combination of fusion and entanglement. However, all contact points of the fiber do not result in fibers fusing together. Generally, the adhesion of the fibers is such that the nonwoven web after being laid down but before further treatment has sufficient MD and CD strength to allow handling of the web without additional treatment. No foreign material is present to promote bonding and essentially no polymer flows to the intersection points when the present process is employed as distinguished from that which occurs during the process of heat-bonding thermoplastic filaments. The bonds are weaker than the filaments as evidenced by the observation that an exertion of a force tending to disrupt the web, as in tufting, will fracture bonds before breaking filaments.

By "substantially continuous", in reference to the polymeric filaments of the webs, it is meant that a majority of the filaments or fibers formed by extrusion through orifices in the rotary die remain as continuous nonbroken fibers as they are drawn and then impacted on the collection device. Some fibers may be broken during the attenuation or drawing process, with a substantial majority of the fibers remaining continuous. Occasional breakage can occur; however, the process of forming of the nonwoven web is not interrupted.

This invention also provides an improved method of forming a self-bonded, fibrous nonwoven web of substantially randomly disposed, substantially continuous polymeric filaments comprising the steps of:

(a) extruding a molten polymer through multiple orifices located in a rotating die, (b) contacting said extruded polymer while hot as it exits said orifices with a fluid stream having a velocity of 14,00 ft/min or greater to form substantially continuous filaments and to draw said filaments into fibers having deniers in the range of about 0.5 to about 20, and (c) collecting said drawn fibers on a collection device whereby the filaments extruded through the die strike the collection device and self-bond to each other to form the nonwoven web.

In one embodiment of the process, the fluid stream is supplied by a fluid delivery system comprising a radial aspirator surrounding the rotary die with the aspirator having an outlet channel with an exit and a blower for providing fluid to the aspirator.

A source of liquid fiber forming material such as a thermoplastic melt is provided and pumped into a rotating die having a plurality of spinnerets about its periphery. The rotating die is rotated at an adjustable speed such that the periphery of the die has a spinning speed of about 150 to about 2000 m/min, calculated by multiplying the periphery circumference by the rotating die rotation speed measured in revolutions per minute.

The thermoplastic polymer melt is extruded through a plurality of spinnerets located about the circumference of the rotating die. There can be multiple spinning orifices per spinneret with the diameter of an individual spinning orifice between about 0.1 to about 2.5 mm preferably about 0.2 to about 1.0 mm. The length-to-diameter ratio of the spinneret diameter is about 1:1 to about 10:1. The particular geometrical configuration of the spinneret orifice can be circular, elliptical, trilobal or any other suitable configuration. Preferably, the configuration of the spinneret orifice is circular or trilobal.

The rate of polymer extruded through the spinneret orifices measured in lb/hr/orifice can range from about 0.05 to about 5.0 lb/hr/orifice. Preferably, the rate is about 0.2 lb/hr/orifice or greater.

As the fibers are extruded horizontally through spinneret orifices in the circumference of the rotating die, the fibers assume a helical orbit as they begin to fall below the rotating die. The fluid stream which contacts the fibers can be directed downward onto the fibers, can surround the fibers or can be directed essentially parallel to the extruded fibers. In one embodiment, a fluid delivery system having a radial aspirator surrounding the rotary die, with the aspirator having an outlet channel with an exit and a blower for providing fluid to the aspirator so that the velocity of the fluid at the exit of the outlet channel of the aspirator is about 14,000 ft/min or greater. Preferably, the fluid is ambient air. The air can also be conditioned by heating, cooling, humidifying, or dehumidifying. The preferred velocity of the air at the exit of the outlet channel of the aspirator is about 20,000 to about 25,000 ft/min. The blower can be a pressure air blower fan capable of generating over 50 inches of water gauge at volumetric flow rates of 3000 cubic feet per minute or more.

Polymer fibers extruded through the spinneret orifices of the rotary die are contacted by the quench air stream of the aspirator. The quench air stream can be directed around, above or essentially parallel to the extruded fibers. It is also contemplated to extrude the filaments into the air stream.

In one embodiment, the quench air stream is directed radially above the fibers which are drawn toward the high velocity air stream as a result of a partial vacuum created in the area of the fiber by the air stream as it exits the aspirator. The polymer fibers then enter the high velocity air stream and are drawn, quenched and transported to a collection surface. The high velocity air, accelerated and distributed in a radial manner, contributes to the attenuation or drawing of the radially extruded thermoplastic melt fibers. The accelerated air velocities contribute to the placement or "laydown" of fibers onto a circular fiber collector surface or collector plate such that nonwoven webs are formed that exhibit improved properties including increased tensile strength, lower elongation, and more balanced physical properties in the MD and CD from fibers having deniers ranging from about 1.0 to about 3.0.

The fibers are conveyed to the collector plate at elevated air speeds of 14,000 ft/min or greater to promote entanglement of the fibers for web integrity and produce a fibrous nonwoven web with more balanced strength properties in the machine direction and cross-machine direction, with a slight predominance in the machine direction tensile strength.

While the fibers are moving at a speed dependent upon the speed of rotation of the die as they are drawn down, by the time the fibers reach the outer diameter of the orbit, they are not moving circumferentially, but are merely being laid down in that particular orbit basically one on top of another. The particular orbit may change depending upon variation of rotational speed, extrudate input, temperature, etc. External forces such as electrostatic charge or air pressure may be used to alter the orbit and, therefore, deflect the fibers into different patterns.

The self-bonded, fibrous nonwoven webs are produced by allowing the extruded thermoplastic fibers to contact each other as the fibers are deposited on a collection surface. Many of the fibers, but not all, adhere to each other at their contact points thereby forming a self-bonded, fibrous nonwoven web. Adhesion of the fibers may be due to fusion of the hot fibers as they contact each other, to entanglement of the fibers with each other or to a combination of fusion and entanglement. Generally, the adhesion of the fibers is such that the nonwoven web after being laid down but before further treatment has sufficient MD and CD strength to allow handling of the web without additional treatment.

The nonwoven fabric will conform to the shape of the collection surface. The collection surface can be of various shapes such as a cone-shaped inverted bucket, a moving screen or a flat surface in the shape of an annular strike plate located slightly below the elevation of the die and with the inner diameter of the annular strike plate being at an adjustable, lower elevation than the outer diameter of the strike plate.

When an annular strike plate is used as the collection surface, many of the fibers are bonded together during contact with each other and with the annular strike plate producing a nonwoven fabric which is drawn back through the aperture of the annular strike plate as a tubular fabric. A stationary spreader can be supported below the rotary die to spread the fabric into a flat two-ply composite which is collected by a pull roll and winder. In the alternative, a knife arrangement can be used to cut the tubular two-ply fabric into a single-ply fabric which can be collected by the pull roll and winder.

Temperature of the thermoplastic melt affects the process stability for the particular thermoplastic used. The temperature must be sufficiently high so as to enable drawdown, but not too high so as to allow excessive thermal degradation of the thermoplastic.

Process parameters which control the fiber formation from thermoplastic polymers include: the spinneret orifice design, dimension and number; the extrusion rate of polymer through the orifices; the quench air velocity; and the rotary die rotational speed.

Fiber denier can be influenced by all of the above parameters with fiber denier typically increasing with larger spinneret orifices, higher extrusion rates per orifice, lower air quench velocity and lower rotary die rotation with other parameters remaining constant.

Productivity is influenced by the dimension and number of spinneret orifices, the extrusion rate and for a given denier fiber the rotary die rotation.

The system provides process parameters whereby various fiber deniers can be attained simply by varying die rotation and/or pumping rate and/or air quench velocity. At a given die rotation, pumping rate and air quench velocity, the denier for individual filaments within a given web can range from about 0.5 to about 20 denier for 90% or greater of the fibers. Typically, the average value for filament denier is in the range of about 1 to about 7. For relatively high air quench velocities the average filament deniers are in range of about 1.0 to about 3.0 denier.

The nonwoven webs exhibit balanced physical properties such that the ratio of the machine direction (MD) tensile strength to the cross direction (CD) tensile strength is close to 1. However, the MD/CD ratio can be varied by varying the quench air velocity to produce webs with predominantly MD or CD strength. Preferably, the ratio of MD to CD tensile strength is about 1:1 to about 1.5:1.

In general, any suitable thermoplastic resin can be used in making the self-bonded, fibrous nonwoven webs of the present invention. Suitable thermoplastic resins include polyolefins of branched and straight-chained olefins such as low density polyethylene, linear low density polyethylene, high density polyethylene, polypropylene, polybutene, polyamides, polyesters such as polyethylene terephthalate, combinations thereof and the like.

The term "polyolefins" is meant to include homopolymers, copolymers and blends of polymers prepared from at least 50 wt. % of an unsaturated hydrocarbon monomer. Examples of such polyolefins include polyethylene, polystyrene, polyvinyl chloride, polyvinyl acetate, polyvinylidene chloride, polyacrylic acid, polymethacrylic acid, polymethyl methacrylate, polyethyl acrylate, polyacrylamide, polyacrylonitrile, polypropylene, polybutene-1, polybutene-2, polypentene-1, polypentene-2, poly-3-methylpentene-1, poly-4-methylpentene-1, polyisoprene, polychloroprene and the like.

Mixtures or blends of these thermoplastic resins and, optionally, thermoplastic elastomers such as polyurethanes and the like, elastomeric polymers such as copolymers of an isoolefin and a conjugated polyolefin, and copolymers of isobutylenes and the like can also be used.

Preferred thermoplastic resins include polyolefins such as polypropylene, linear low density polyethylene, blends of polypropylene and polybutene, and blends of polypropylene and linear low density polyethylene.

Additives such as colorants, pigments, dyes, opacifiers such as $TiO_2$, UV stabilizers, fire retardant compositions, processing stabilizers and the like can be incorporated into the polypropylene, thermoplastic resins and blends.

The polypropylene used by itself or in blends with polybutene (PB) and/or linear low density polyethylene (LLDPE) preferably has a melt flow rate in the range of about 10 to about 80 g/10 min as measured by ASTM D-1238. Blends of polypropylene and polybutene and/or linear low density polyethylene provide self-bonded nonwoven webs with softer hand such that the web has greater flexibility and/or less stiffness.

The blends of polypropylene and PB can be formulated by metering PB in liquid form into a compounding extruder by any suitable metering device by which the amount of PB being metered into the extruder can be controlled. PB can be obtained in various molecular weight grades with high molecular weight grades typically requiring heating to reduce the viscosity for ease of transferring the PB. A stabilizer additive package can be added to the blend of polypropylene and PB if desired. Polybutenes suitable for use can have a number average molecular weight ($M_n$) measured by vapor phase osmometry of about 300 to about 3000. The PB can be prepared by well-known techniques such as the Friedel-Crafts polymerization of feedstocks comprising isobutylene, or they can be purchased from a number of commercial suppliers such as Amoco Chemical Company, Chicago, Ill., which markets polybutenes under the tradename Indopol ®. A preferred number average molecular weight for PB is in the range of about 300 to about 2500.

The PB can be added directly to polypropylene or it can be added via a masterbatch prepared by adding PB to polypropylene at weight ratios of 0.2 to 0.3 based on polypropylene in a mixing device such as a compounding extruder with the resulting masterbatch blended with polypropylene in an amount to achieve a desired level of PB. The weight ratio of PB typically added to polypropylene can range from about 0.01 to about 0.15. When a weight ratio of PB below about 0.01 is added to polypropylene, little beneficial effects such as better hand and improved softness are shown in the blends, and when polybutene is added at a weight ratio above about 0.15, minute amounts of PB can migrate to the surface which may detract from the fabric appearance. Blends of polypropylene and PB can have a weight ratio of polypropylene in the range of about 0.99 to about 0.85, preferably about 0.99 to about 0.9, and a weight ratio of PB in the range of about 0.01 to about 0.15, preferably about 0.01 to about 0.10.

Blends of polypropylene and LLDPE can be formulated by blending polypropylene resin in the form of pellets or powder with LLDPE in a mixing device such as a drum tumbler and the like. The resin blend of polypropylene and LLDPE with optional stabilizer additive package can be introduced to a polymer melt mixing device such as a compounding extruder of the type typically used to produce polypropylene product in a polypropylene production plant and compounded at temperatures between about 300° F. and about 500° F. Although blends of polypropylene and LLDPE can range from a weight ratio of nearly 1.0 for polypropylene to a weight ratio of nearly 1.0 for LLDPE, typically, the blends of polypropylene and LLDPE useful for making self-bonded webs used in the coated self-bonded nonwoven web composites of the instant invention can have a weight ratio of polypropylene in the range of about 0.99 to about 0.85, preferably in the range of about 0.98 to about 0.92, and a weight ratio of LLDPE in the range of about 0.01 to about 0.15, preferably in the range of about 0.02 to about 0.08. For weight ratios less than 0.01 the softer hand properties imparted from the LDPE are not obtained, and for weight ratios above 0.15 less desirable physical properties and a smaller processing window are obtained.

The linear low density polyethylenes which can be used in making the self-bonded, fibrous nonwoven webs of the present invention can be random copolymers of ethylene with 1 to 15 weight percent of higher olefin comonomers such as propylene, n-butene-1, n-hexene-1, n-octene-1 or 4-methylpentene-1 produced over transition metal coordination catalysts. Such linear low density polyethylenes can be produced in liquid phase or vapor phase processes. The preferred density of the linear low density polyethylene is in the range of about 0.91 to about 0.94 g/cc.

Applications for the self-bonded, fibrous nonwoven webs of this invention and for composite products comprising the nonwoven web of the present invention bonded to at least one additional material selected from the group consisting of fabric, film and nonfabric material include: coverstock in the hygienic market, wraps for surgical instruments, surgical caps, gowns, patient drapes, surgical table covers, isolation gowns, robe lining and facings, mattress pads, covers, tickings, shower curtains, drapes, drapery liners, pillow cases, bedspreads, quilts, sleeping bags, liners, weed control and seed/crop cover in the agricultural market, house wrap in the construction market, coating substrate for a variety of wipes, recreational fabric applications including tents, outer wear, tarpulins and the like.

The self-bonded, fibrous nonwoven webs of the present invention can be used as one or more layers bonded to each other or bonded to at least one material selected from the group consisting of fabric, film and nonfabric material to form a composite product. The bonding can be accomplished by thermal bonding, point embossing, needle punching or any other suitable bonding technique used in woven and nonwoven technology. The additional layers can be one or more like or different materials such as a woven fabric, a spunbonded nonwoven fabric, a meltblown nonwoven fabric, a carded web, a porous film, an impervious film, metallic foils and the like. The bonding parameters, e.g., temperature, pressure, dwell time in the nip, number of bonds or perforations per square inch and percent area coverage are determined by the polymer material used and by the characteristics preferred in the finished product. Composite products combine the nonwoven web of the present invention which has very uniform basis weight properties and balanced physical properties such as tensile strength with one or more distinct materials.

In the alternative because the nonwoven web of the present invention has a uniform basis weight and improved physical properties, the web can be used by itself without further processing. However, processes typically used in the production of nonwoven webs such as calendering, embossing, uniaxial and biaxial stretching can be used in post-treatment of the nonwoven webs of the present invention.

A qualitative comparison of the properties of the nonwoven web of the present invention with a prior art self-bonded web and a typical spunbond web is given in Table I below.

TABLE I

| | Comparison of Nonwoven Webs | | |
|---|---|---|---|
| Property | Present Invention | Prior Art Self-Bonded | Spunbond |
| Filament Type | Continuous | Continuous | Continuous |
| Average Denier | ≧1 | ≧5 | ≧1 |
| Denier Variation | Medium-large | Medium-large | Little |
| Web Uniformity | Very uniform | Uniform | Non-uniform |
| Filament Bonding Within Webs | Self-bonded | Self-bonded | In-line bonding required |

While the invented webs exhibit web uniformity approaching that of conventional meltblown webs, there are significant differences including the invented web's substantially continuous filaments and relatively high strength as opposed to meltblown's low strength webs of discontinuous filaments.

Turning now to FIG. 1 there is schematically shown a system 300 for producing a self-bonded, fibrous nonwoven web of the present invention. System 300 includes an extruder 310 which extrudes a fiber forming material such as a thermoplastic polymer melt through feed conduit and adapter 312 to a rotary union 315. A positive displacement melt pump 314 may be located in the feed conduit 312 if the pumping action provided by extruder 310 is not sufficiently accurate for the desired operating conditions. An electrical control can be provided for selecting the rate of extrusion and displacement of the extrudate through the feed conduit 312. Rotary drive shaft 316 is driven by motor 320 at a speed selected by a control means (not shown) and is coupled to rotary die 330. Radial air aspirator 335 is located around rotary die 330 and is connected to air blower 325. Air blower 325, air aspirator 335, rotary die 330, motor 320 and extruder 310 are supported on or attached to frame 305.

In operation, fibers are extruded through and thrown from the rotary die 330 by centrifugal action into a high velocity air stream provided by aspirator 335. The air drag created by the high velocity air causes the fibers to be drawn down from the rotary die 330 and also to be stretched or attenuated. A web forming plate 345 in the shape of an annular ring surrounds the rotary die 330. As rotary die 330 is rotated and fibers 340 extruded, the fibers 340 strike the web forming plate 345. Web forming plate 345 is attached to frame 305 with support arm 348. Fibers 340 are self-bonded during contact with each other and plate 345 thus forming a tubular nonwoven web 350. The tubular nonwoven web 350 is then drawn through the annulus of web forming plate 345 by pull rolls 370 and 365 through nip rolls 360 supported below rotary die 330 which spreads the fabric into a flat two-ply composite 355 which is collected by pull rolls 365 and 370 and may be stored on a roll (not shown) in a standard fashion.

Figure 2:
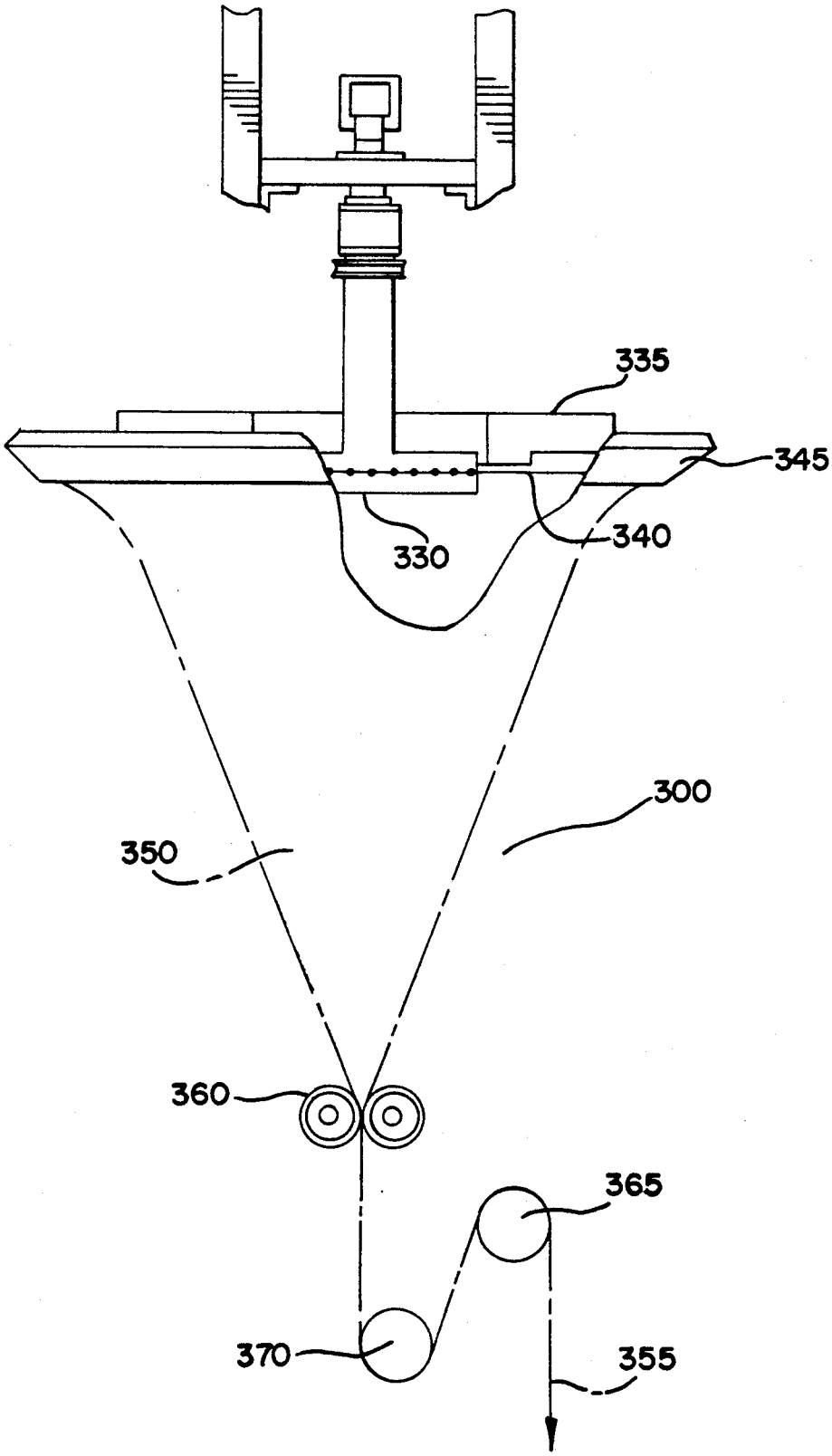
FIG. 2 is a side view of the system of FIG. 1.

FIG. 2 is a side view of system 300 of FIG. 1 schematically showing fibers 340 being extended form rotary die 330, attentuated by the high velocity air from aspirator 335, contacting of fibers 340 on web forming plate 345 to form tubular nonwoven web 350. Tubular nonwoven web 350 is drawn through nip rolls 360 by pull rolls 370 and 365 to form flat two-ply composite 355.

The self-bonded, nonwoven web can be supplied directly from the process described above or from product wound on an unwind roll. The self-bonded nonwoven web can be either a single-ply or a multi-ply nonwoven web. Typically, a two-ply web is used such that a layer of a self-bonded web having a nominal basis weight of 0.2 oz/yd$^2$ or greater comprises two plies of a self-bonded web each having a nominal basis weight of 0.1 oz/yd$^2$ or greater. The two-ply self-bonded web enhances the excellent uniform basis weight of the single plies that make up the two-ply, self-bonded nonwoven webs. The self-bonded, nonwoven web can have post-treatment, such as thermal bonding, point-bonding and the like. One embodiment produces a two-ply, nonwoven web of the present invention and uses no post-treatment before the web is used to form composite structures.

Test procedures used to determine the properties reported for the Examples are listed below:

Tensile and Elongation-Test specimens are used to determine tensile strength and elongation according to ASTM Test Method D-1682. Grab tensile strength can be measured in MD on 1 inch wide samples of the fabric or in the CD and is reported in units of lbs. A high value is desired for tensile strength.

Elongation can also be measured in the MD or in the CD and is reported in units of %. Lower values are desired for elongation.

Trapezoidal Tear Strength-The trapezoidal tear strength is determined by ASTM Test Method D-1117.14 and can be measured in the MD or in the CD and is reported in units of lbs with a high value desired.

Fiber Denier-The fiber diameter is determined by comparing a fiber specimen sample to a calibrated reticle under a microscope with suitable magnification. From known polymer densities, the fiber denier is calculated.

Basis Weight-The basis weight for a test sample is determined by ASTM Test Method D 3776 option C.

Basis Weight Uniformity Index-The BWUI is determined for a nonwoven web by cutting a number of unit area and larger area samples from the nonwoven web. The method of cutting can range from the use of scissors to stamping out unit areas of material with a die which will produce a consistently uniform unit area sample of nonwoven web. The shape of the unit area sample can be square, circular, diamond or any other convenient shape. The unit area is 1 in$^2$, and the number of samples is sufficient to give a 0.95 confidence interval for the weight of the samples. Typically, the number of samples can range from about 40 to 80. From the same nonwoven web an equivalent number of larger area samples are cut and weighed. The larger samples are obtained with appropriate equipment with the samples having areas which are N times larger than the unit area samples, where N is about 12 to about 18. The average basis weight is calculated for both the unit area sample and the larger area sample, with the BWUI ratio determined from the average basis weight of the unit area divided by the average basis weight of the larger area. Materials which have unit area and/or area average basis weights determined with standard deviations greater than 10% are not considered to have uniform basis weights as defined herein.

The following examples further illustrate the present invention, although it will be understood that these examples are for purposes of illustration, and are not intended to limit the scope of the invention.

Example 1

A polypropylene resin, having a nominal melt flow rate of 35 g/10 min, was extruded at a constant extrusion rate into and through a rotary union, passages of the rotating shaft and manifold system of the die and spinnerets to an annular plate similar to the equipment described in FIG. 1.

| The process conditions were: | |
|---|---|
| Extrusion conditions | |
| Temperature, °F. | |
| Zone -1 | 450 |
| Zone -2 | 500 |
| Zone -3 | 580 |
| Adapter | 600 |
| Rotary union | 425 |
| Die | 425 |
| Pressure, psi | 200–400 |
| Die rotation, rpm | 2500 |
| Air quench pressure, in of $H_2O$ | 52 |
| Extrudate, lb/hr/orifice | 0.63 |
| Product-2-ply, lay flat fabric | |
| Basis weight, oz/yd$^2$ | 1.0 |

EXAMPLE 2

Physical properties including web thickness, web basis weight for one-inch square and four-inch square samples, tensile strengths in the machine direction and the cross direction were determined for the 1 oz/yd$^2$ basis weight nonwoven web of Example 1 and for a commercially available 1 oz/yd$^2$ basis weight, spunbonded, polypropylene fabric identified as Wayn-Tex Elite.

The number of test specimens (samples) for the thickness and basis weight tests was 60, and for the tensile test the number was 20. The measured property values were significant at the 0.95 confidence interval. The measured properties are tabulated in Table II below.

A nominal 1.0 oz/yd$^2$ uniform basis weight self-bonded polypropylene nonwoven web was prepared by the method described above and filament denier, basis weights for 1 in×1 in and 4 in×4 in samples, cross machine direction and machine direction tensile strengths were determined for this self-bonded nonwoven web as well as for nominal 1.0 oz/yd$^2$ basis weight spunbond materials such as Kimberly-Clark's Accord (Comparative A), James River's Celestra (Comparative B) and Wayn-Tex's Elite (Comparative C). These properties are summarized in Tables III–VII below.

TABLE II

Physical Property Comparison
Example 1 with a Spunbonded Fabric

| Property | Example 1 | Comparator Spunbonded Fabric |
|---|---|---|
| Thickness, mils | | |
| Samples, number | 60 | 60 |
| Average thickness | 11.04 | 11.01 |
| Coefficient of variation | 1.50075 | 2.35100 |
| Standard deviation | 1.22505 | 1.53357 |
| Range | 6 | 7 |
| Basis Weight | | |
| Samples, number | 60 | 60 |
| Test specimen, type | 1-in square | 1-inch square |
| Weight, g | | |
| Average | 0.02122 | 0.02417 |
| Coefficient of variation | $1.9578 \times 10^{-6}$ | $2.1278 \times 10^{-5}$ |

TABLE II-continued

Physical Property Comparison
Example 1 with a Spunbonded Fabric

| Property | Example 1 | Comparator Spunbonded Fabric |
|---|---|---|
| Standard deviation | $1.3992 \times 10^{-3}$ | $4.6129 \times 10^{-3}$ |
| Range | $5.3 \times 10^{-3}$ | 0.023 |
| Basis weight, oz/yd$^2$ | 0.9692 | 1.1039 |
| Samples, number | 60 | 60 |
| Test specimen, type | 4-in square | 4-in square |
| Weight, g | | |
| Average | 0.3370 | 0.3601 |
| Coefficient of variation | $2.6348 \times 10^{-4}$ | $2.6188 \times 10^{-3}$ |
| Standard deviation | $1.6232 \times 10^{-2}$ | 0.05118 |
| Range | 0.068 | 0.2352 |
| Basis weight, oz/yd$^2$ | 0.9620 | 1.0280 |
| Basis Weight Uniformity Index | 1.0075 | 1.074 |
| Tensile Strength | | |
| Samples, number | 20 | 20 |
| Grab tensile strength (MD), lb | | |
| Average | 6.1547 | 5.5102 |
| Coefficient of variation | 0.6790 | 2.7978 |
| Standard deviation | 0.8240 | 1.6727 |
| Range | 2.829 | 6.615 |
| Samples, number | 20 | 20 |
| Grab tensile strength (CD), lb | | |
| Average | 4.5299 | 3.2697 |
| Coefficient of variation | 0.03326 | 0.7989 |
| Standard deviation | 0.1824 | 0.8937 |
| Range | 0.656 | 2.888 |

TABLE III

NONWOVEN WEB PROPERTIES
Basis Weight - 4 in × 4 in Square Samples

| Property | Self-bonded Nonwoven Web | Comparative A | Comparative B | Comparative C |
|---|---|---|---|---|
| Number of Samples | 60 | 60 | 60 | 18 |
| Sample Area, in$^2$ | 16 | 16 | 16 | 16 |
| Basis Weight, oz/yd$^2$ | | | | |
| Average | 0.968667 | 0.998833 | 1.01317 | 0.967778 |
| Median | 0.97 | 1.01 | 1.00 | 0.98 |
| Variance | $2.43887 \times 10^{-3}$ | $7.09523 \times 10^{-3}$ | $6.84234 \times 10^{-3}$ | $1.42418 \times 10^{-2}$ |
| Minimum | 0.86 | 0.8 | 0.82 | 0.78 |
| Maximum | 1.07 | 1.21 | 1.2 | 1.21 |
| Range | 0.21 | 0.41 | 0.38 | 0.43 |
| Standard Deviation (SD) | 0.0493849 | 0.0842332 | 0.0827185 | 0.119339 |
| SD, % of Average | 5.10 | 8.43 | 8.16 | 12.33 |

TABLE IV

NONWOVEN WEB PROPERTIES
Basis Weight - 1 in × 1 in Square Samples

| Property | Self-bonded Nonwoven Web | Comparative A | Comparative B | Comparative C |
|---|---|---|---|---|
| Number of Samples | 60 | 60 | 60 | 60 |
| Sample Area, in$^2$ | 1 | 1 | 1 | 1 |
| Basis Weight, oz/yd$^2$ | | | | |
| Average | 0.993667 | 0.9665 | 0.9835 | 0.945167 |
| Median | 0.99 | 0.965 | 0.97 | 0.97 |
| Variance | $4.50836 \times 10^{-3}$ | 0.0186774 | 0.0245214 | 0.0251847 |
| Minimum | 0.88 | 0.69 | 0.69 | 0.62 |
| Maximum | 1.17 | 1.26 | 1.32 | 1.34 |
| Range | 0.29 | 0.57 | 0.63 | 0.72 |
| Standard Deviation (SD) | 0.0671443 | 0.136665 | 0.156593 | 0.158697 |
| SD, % of Average | 6.76 | 14.14 | 15.92 | 16.79 |
| BWUI | 1.026 | 0.968* | 0.971* | 0.977* |

*SD 10% of average for one or both basis weights.

TABLE V

| Property | NONWOVEN WEB PROPERTIES Filament Denier Self-bonded Nonwoven Web | Comparative A | Comparative B | Comparative C |
|---|---|---|---|---|
| Number of Samples | 100 | 100 | 100 | 100 |
| Denier | | | | |
| Average | 2.254 | 2.307 | 3.962 | 5.295 |
| Median | 1.7 | 2.2 | 4.2 | 5.8 |
| Variance | 1.22473 | 0.206718 | 0.326622 | 0.82048 |
| Minimum | 0.9 | 1.2 | 2.8 | 2.2 |
| Maximum | 5.8 | 4.2 | 5.8 | 7.7 |
| Range | 4.9 | 3 | 3 | 5.5 |
| Standard Deviation (SD) | 1.10668 | 0.454663 | 0.571509 | 0.905803 |
| SD, % of Average | 49.10 | 19.71 | 14.42 | 17.11 |

TABLE VI

| Property | NONWOVEN WEB PROPERTIES Cross Machine Direction Tensile Strength Self-bonded Nonwoven Web | Comparative A | Comparative B | Comparative C |
|---|---|---|---|---|
| Number of Samples | 30 | 30 | 30 | 18 |
| Tensile Strength, lb | | | | |
| Average | 4.60217 | 9.14053 | 2.94907 | 4.00072 |
| Median | 4.694 | 9.035 | 2.772 | 3.9435 |
| Variance | 0.19254 | 2.09982 | 0.271355 | 1.71677 |
| Minimum | 3.742 | 5.318 | 2.166 | 1.399 |
| Maximum | 5.374 | 11.56 | 4.443 | 6.15 |
| Range | 1.632 | 6.242 | 2.277 | 4.751 |
| Standard Deviation (SD) | 0.438794 | 1.44908 | 0.520918 | 1.31025 |
| SD, % of Average | 9.53 | 15.85 | 17.66 | 32.75 |

TABLE VII

| Property | NONWOVEN WEB PROPERTIES Machine Direction Tensile Strength Self-bonded Nonwoven Web | Comparative A | Comparative B | Comparative C |
|---|---|---|---|---|
| Number of Samples | 30 | 30 | 30 | 18 |
| Tensile Strength, lb | | | | |
| Average | 4.7511 | 5.51813 | 8.56907 | 6.93222 |
| Median | 4.7675 | 5.4755 | 8.7675 | 6.4725 |
| Variance | 0.0789548 | 0.686962 | 1.22762 | 5.84547 |
| Minimum | 4.15 | 3.71 | 6.489 | 3.436 |
| Maximum | 5.251 | 7.04 | 10.21 | 12.16 |
| Range | 1.101 | 3.33 | 3.721 | 8.724 |
| Standard Deviation (SD) | 0.280989 | 0.828832 | 1.10798 | 2.41774 |
| SD, % of Average | 5.91 | 15.02 | 12.93 | 34.88 |

EXAMPLE 3

A polypropylene resin, having a nominal melt flow rate of 35 g/10 min, was extruded at a constant extrusion rate into and through a rotary union, passages of the rotating shaft and manifold system of the die and spinnerets to an annular plate in the equipment as shown in FIG. 1 and described above.

The process conditions were:

| | |
|---|---|
| Extrusion conditions | |
| Temperature, °F. | |
| Zone -1 | 450 |
| Zone -2 | 500 |
| Zone -3 | 580 |
| Adapter | 600 |
| Rotary union | 425 |
| Die | 425 |
| Screw rotation, rpm | 35 |
| Pressure, psi | 600 |
| Rotary die conditions | |
| Die rotation, rpm | 2500 |
| Extrudate rate, lb/hr/orifice | 0.54 |

-continued

| | |
|---|---|
| Air quench conditions | |
| Air quench pressure, in of H2O | 52 |
| Air quench velocity at aspirator exit, ft/min | 24,000 |
| Product physical characteristics | |
| Filament Denier (average) | 2.8 |
| Basis weight, oz/yd$^2$ | 2.0 |
| Grab tensile strength MD, lbs | 53.9 |
| CD, lbs | 34.6 |
| Elongation MD, % | 144 |
| CD, % | 118 |
| Trap tear MD, lbs | 25.0 |
| CD, lbs | 14.9 |

Example 4

A polypropylene resin, having a nominal melt flow rate of 35 g/10 min, was extruded at a constant extrusion rate into and through a rotary union, passages of the rotating shaft and manifold system of the die and spinnerets to an annular plate in the equipment as shown in FIG. 1 and described above.

The process conditions were:

| | |
|---|---|
| Extrusion conditions | |
| Temperature, °F. | |
| Zone -1 | 450 |
| Zone -2 | 500 |
| Zone -3 | 580 |
| Adapter | 600 |
| Rotary union | 425 |
| Die | 425 |
| Screw rotation, rpm | 25 |
| Pressure, psi | 500 |
| Rotary die conditions | |
| Die rotation, rpm | 2700 |
| Extrudate rate, lb/hr/orifice | 0.42 |
| Air quench conditions | |
| Air quench pressure, in of H2O | 52 |
| Air quench velocity at aspirator exit, ft/min | 24,000 |
| Product physical characteristics | |
| Filament Denier (average) | 1.8 |
| Basis weight, oz/yd$^2$ | 2.0 |
| Grab tensile MD, lbs | 29.4 |
| CD, lbs | 29.9 |
| Elongation MD, % | 143 |
| CD, % | 83 |
| Trap tear MD, lbs | 14.7 |
| CD, lbs | 16.7 |

Comparative Example

A polypropylene resin, having a nominal melt flow rate of 35 g/10 min, was extruded at a constant extrusion rate into and through a rotary union, passages of the rotating shaft and manifold system of the die and spinnerets to an annular plate in the equipment as shown in FIG. 1 and described above.

The process conditions were:

| | |
|---|---|
| Extrusion conditions | |
| Temperature, °F. | |
| Zone -1 | 450 |
| Zone -2 | 500 |
| Zone -3 | 580 |
| Adapter | 600 |
| Rotary union | 425 |
| Die | 425 |
| Screw rotation, rpm | 70 |
| Pressure, psi | 800 |
| Rotary die conditions | |
| Die rotation, rpm | 2400 |
| Extrudate rate, lb/hr/orifice | 1.2 |
| Air quench conditions | |
| Air quench pressure, in of $H_2O$ | NM |
| Air quench velocity at aspirator exit, ft/min | 11,500 |
| Product physical characteristics | |
| Filament Denier (average) | 6.0 |
| Basis weight, oz/yd$^2$ | 2.0 |
| Grab tensile MD, lbs | 18.5 |
| CD, lbs | 23.0 |
| Elongation MD, % | 170 |
| CD, % | 250 |
| Trap tear MD, lbs | 10.0 |
| CD, lbs | 14.0 |
| NM = Not Measured | |

EXAMPLE 5

SELF-BONDED NONWOVEN WEB PREPARATION FROM A BLEND OF POLYPROPYLENE AND POLYBUTENE

A blend of 93 wt. % of a polypropylene having a nominal melt flow rate of 38 g/10 min and 7 wt. % of polybutene having a nominal number average molecular weight of 1290 was melt-blended in a Werner & Pfleiderer ZSK-57 twin-screw extruder and Luwa gear pump finishing line. The resulting product was extruded at a constant extrusion rate into and through a rotary union, passages of the rotating shaft and manifold system of the die and spinnerets to an annular plate in the equipment as shown in FIG. 1 and described above.

The process conditions were:

| | |
|---|---|
| Extrusion conditions | |
| Temperature, °F. | |
| Zone -1 | 435 |
| Zone -2 | 450 |
| Zone -3 | 570 |
| Adapter | 570 |
| Rotary union | 550 |
| Die | 450 |
| Screw rotation, rpm | 50 |
| Pressure, psi | 800 |
| Rotary die conditions | |
| Die rotation, rpm | 2100 |
| Extrudate rate, lb/hr/orifice | 0.78 |
| Product physical characteristics | |
| Filament Denier (average) | 3–4 |
| Basis weight, oz/yd$^2$ | 1.25 |
| Grab tensile MD, lbs | 13.4 |
| CD, lbs | 9.0 |
| Elongation MD, % | 150 |
| CD, % | 320 |
| Trap tear MD, lbs | 7.5 |
| CD, lbs | 5.8 |

EXAMPLE 6

SELF-BONDED NONWOVEN WEB PREPARATION FROM A BLEND OF POLYPROPYLENE AND LINEAR LOW DENSITY POLYETHYLENE

A blend of 95 wt. % of a polypropylene having a nominal melt flow rate of 38 g/10 min and 5 wt. % of a linear low density polyethylene having a nominal density of 0.94 g/cc was melt-blended in a 2.5 in Davis Standard single-screw extruder. The resulting product was extruded at a constant extrusion rate into and through a rotary union, passages of the rotating shaft and manifold system of the die and spinnerets to an annular plate in the equipment as shown in FIG. 1 and described above.

The process conditions were:

| | |
|---|---|
| Extrusion conditions | |
| Temperature, °F. | |
| Zone -1 | 490 |
| Zone -2 | 540 |
| Zone -3 | 605 |
| Adapter | 605 |
| Rotary union | 550 |
| Die | 450 |
| Screw rotation, rpm | 40 |
| Pressure, psi | 1000 |
| Rotary die conditions | |
| Die rotation, rpm | 2100 |
| Extrudate rate, lb/hr/orifice | 0.65 |
| Air quench conditions | |
| Air quench pressure, in of $H_2O$ | 55 |
| Product physical characteristics | |
| Basis weight, oz/yd$^2$ | 0.25 |

What is claimed is:

1. A uniform basis weight self-bonded, fibrous nonwoven web comprising a plurality of substantially randomly disposed, substantially continuous polymeric filaments wherein said web has a basis weight of about 0.1 oz/yd$^2$ or greater and a Basis Weight Uniformity Index of 1.0±0.05 determined from average basis weights having standard deviations of less than 10%.

2. The web of claim 1 wherein said polymeric filaments comprise a thermoplastic selected from the group consisting of polypropylene, high density polyethylene, low density polyethylene, linear low density polyethylene, polyamide, polyester, a blend of polypropylene and polybutene, and a blend of polypropylene and linear low density polyethylene.

3. The web of claim 2 wherein said polymeric filaments comprise a polypropylene having a melt flow rate in the range of about 10 to about 80 g/10 min as measured by ASTM D-1238.

4. A uniform basis weight self-bonded, fibrous nonwoven web comprising a plurality of substantially randomly disposed, substantially continuous polymeric filaments wherein said polymeric filaments comprise a blend of a polypropylene and a polybutene wherein said polypropylene has a melt flow rate in the range of about 10 to about 80 g/10 min as measured by ASTM D-1238 and has a weight ratio of about 0.99 to about 0.85 and wherein said polybutene has a number average molecular weight in the range of about 300 to about 2,500 and has a weight ratio of about 0.01 to about 0.15 wherein said web has a basis weight of about 0.1 oz/yd$^2$ or greater and a Basis Weight Uniformity Index of 1.0±0.05 determined from average basis weights having standard deviations of less than 10%.

5. A uniform basis weight self-bonded, fibrous nonwoven web comprising a plurality of substantially randomly disposed, substantially continuous polymeric filaments wherein said polymeric filaments comprise a blend of polypropylene and linear low density polyethylene wherein said polypropylene has a melt flow rate in the range of about 10 to about 80 g/10 min as measured by ASTM D-1238 and has a weight ratio of about 0.99 to about 0.85 and wherein said linear low density polyethylene has a density in the range of about 0.91 to about 0.94 g/cc and has a weight ratio of about 0.01 to about 0.15 wherein said web has a basis weight of about 0.1 oz/yd$^2$ or greater and a Basis Weight Uniformity Index of 1.0±0.05 determined from average basis weights having standard deviations of less than 10%.

6. The web of claim 1 wherein said Basis Weight Uniformity Index is 1.0±0.03.

7. The web of claim 1 wherein said polymeric filaments have deniers in the range of about 0.5 to about 20.

8. The web of claim 7 wherein said polymeric filaments have an average denier in the range of about 1 to about 7.

9. The web of claim 1 wherein a ratio of machine direction to cross direction tensile strength is about 1:1 to about 1.5:1.

10. A composite product comprising the nonwoven web of claim 1 bonded to at least one material selected from the group consisting of fabric, film and nonfabric material.

11. The composite product of claim 10 having an embossed design on at least one surface thereof.

12. The composite product of claim 10 wherein said nonwoven web and said material are thermally bonded.

13. The composite product of claim 10 wherein said material comprises a woven fabric.

14. The composite product of claim 10 wherein said material comprises a nonwoven fabric.

15. The composite product of claim 14 wherein said nonwoven fabric comprises a meltblown fabric.

16. The composite product of claim 14 wherein said nonwoven fabric comprises a spunbond fabric.

17. The composite product of claim 14 wherein said nonwoven fabric comprises a carded web.

18. The nonwoven web of claim 4 wherein said polymeric filaments have deniers of about 0.5 to about 20.

19. A composite product comprising at least one layer of said nonwoven web of claim 4.

20. The nonwoven web of claim 5 wherein said polymeric filaments have deniers of about 0.5 to about 20.

21. A composite product comprising at least one layer of said nonwoven web of claim 5.

* * * * *